United States Patent [19]

Meaden et al.

[11] 3,978,752

[45] Sept. 7, 1976

[54] INTERMITTENT PERFORATOR WHEEL

[75] Inventors: Thomas F. Meaden, LaGrange; George W. Fieberg, Melrose Park, both of Ill.

[73] Assignee: Meaden Screw Products Company, Chicago, Ill.

[22] Filed: Dec. 29, 1975

[21] Appl. No.: 645,283

[52] U.S. Cl. ..... 83/678; 83/332

[51] Int. Cl.[2] ..... B26F 1/20

[58] Field of Search ..... 83/332, 678, 695; 93/58.1, 58.2 R, 58.4

[56] References Cited

UNITED STATES PATENTS

| | | | |
|---|---|---|---|
| 3,268,136 | 8/1966 | Huffman | 83/678 X |
| 3,847,045 | 11/1974 | Willhite | 83/332 X |

*Primary Examiner*—J. M. Meister

*Attorney, Agent, or Firm*—Wegner, Stellman, McCord, Wiles & Wood

[57] ABSTRACT

An intermittent perforator wheel structure for providing a tearing edge in a workpiece sheet. The tearing edge is defined by a line of spaced elongated slits and a line of spaced short perforation slits offset from the line of elongated slits. The offset is made to be a small preselected amount. The offset may be preselected to assure that the torn portions of the sheet provided by the spaces between the short slits do not extend beyond the line of elongated slits whereby the edge of the sheet seen by a data processing machine, or the like, into which the sheet may be fed comprises a smooth edge with the torn portions being recessed within the straight smooth edge.

11 Claims, 5 Drawing Figures

INTERMITTENT PERFORATOR WHEEL

BACKGROUND OF THE INVENTION

1. Field of the Invention

This invention relates to slitting means and in particular to perforator wheels.

2. Description of the Prior Art

In the conventional perforation of workpiece sheets, a plurality of spaced slits are provided. The nonslit portions of the sheet between the slits may then be readily torn to permit separation of the sheet when desired along the slit line. A number of different configurations for such slit tear lines has been developed. The present invention comprehends an improved structure for providing a novel tear line configuration.

Illustrative of the prior art structures is that of William M. Strange United States Letters Pat. No. 3,205,750 which shows means for perforating paperboard utilizing blades having sharp toothed edges adapted to provide a series of spaced cuts that extend completely through the thickness of the paperboard and intermediate cuts that extend only partially therethrough.

Harold W. Huffman, in United States Letters Pat. No. 3,268,136, shows a data card and method of making the same where adjacent portions of adjoining cards have finished edges common to both cards. The method further contemplates providing tear strips along the opposite edges having notches wherein the edges of primary cuts collectively constitute an end of the card with the tufts of paper stock resulting from tearing of the strip being disposed within recesses in the slit edge.

Valone V. Weyant, in United States Letters Pat. No. 3,440,915, shows a quick release connection for connecting a cutting blade to an arbor in an edge trimming apparatus.

Stanley Milton Silver, in United States Letters Pat. No. 3,463,039, shows a knife for cutting tear-lines in cardboard and the like wherein a tongue-and-groove type edge configuration is obtained by a staggered relationship of a pair of slitting blades. The tear lines are defined by a pair of cutter blades separated by a rubber spacer.

Thomas Lynch et al, in United States Letters Pat. No. 3,855,890, show a slitter/perforator apparatus having a cutting blade and a perforator blade which are arranged to be selectively utilized to provide either a cutting or perforating operation. The cutting operation produces a continuous slit whereas the perforating operation provides a discontinuous slit in the workpiece sheet.

In United States Letters Pat. No. 3,880,030 of Stanley Irving Rosengren, a rotary cutter assembly is shown having a notch cutting wheel for receiving bars.

SUMMARY OF THE INVENTION

The present invention comprehends an improved intermittent perforator wheel structure whereby a tearing edge is formed having an elongated continuous slit and an offset group of spaced short slits. The offset group of short slits defines a tearable edge portion intermediate the elongated slit portions of the workpiece sheet. The offset of the line of short slits from the line of elongated slits is preselected to assure that the tufts resulting from the tearing of the sheet do not extend beoynd the line of elongated slits whereby the effective outer edge of the separated sheet is smooth, as defined by the elongated slit portions.

The perforator wheel structure herein includes a first wheel having a peripheral cutting edge provided with a plurality of elongated recesses spaced apart by elongated cutting edge portions, a second wheel having a peripheral cutting edge provided with a plurality of spaced groups of short recesses spaced apart by short cutting edge portions, and a plurality of elongated recesses intermediate the groups, and means for coaxially securing the wheels with the peripheral edgtes juxtaposed and with the groups of short recesses of the second wheel aligned one each with the elongated recesses of the first wheel whereby the elongated cutting edge portions of the first wheel comprise means for providing a plurality of spaced elongated slits in a workpiece sheet and the short cutting edge portions of the second wheel comrpise means for providing a plurality of spaced short perforation slits in the workpiece sheet intermediate the elongated slits thereby cooperatively defining a tearing edge having alternating spaced long slits and groups of short perforation slits.

More specifically, the first and second wheels are spaced apart by an intermediate spacer element which may comprise an annular element coaxially secured between the cutter wheels.

The cutter wheels may be press-fitted to an axial bearing means, or other suitable mounting member. The width of the spacer elements is preselected to provide the desired recessing of the torn tufts in the workpiece sheet, as discussed above. More specifically, in the illustrated embodiment, the width of the spacer element is made to be greater than the length of the short recesses of the second wheel. The width of the spacer slots may be made to be greater than the length of the short cutting edge portions of the second wheel.

Thus, the intermittent perforator wheel of the present invention is extremely simple and economical of construction while yet providing the highly desirable features discussed above.

BRIEF DESCRIPTION OF THE DRAWING

Other features and advantages of the invention will be apparent from the following description taken in connection with the accomanying drawing wherein.

DESCRIPTION OF THE PREFERRED EMBODIMENT

Figure 1:
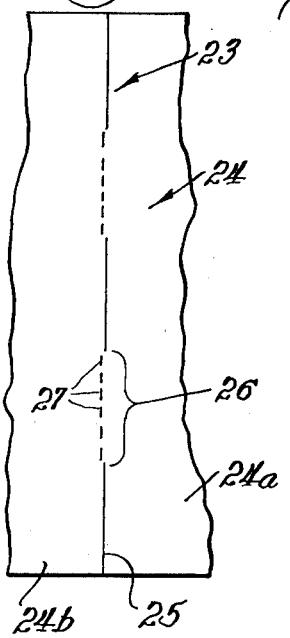
FIG. 1 is a fragmentary plan view of a workpiece sheet provided with a slit tearing edge embodying the invention.

In the exemplary embodiment of the invention as disclosed in the drawing, an intermittent perforator wheel structure generally designated 10 is shown to comprise a first cutter wheel 11, a second cutter wheel 12, and an intermediate spacer element 13 coaxially carried on a bearing 14 journaled on a shaft 15.

Figure 3:
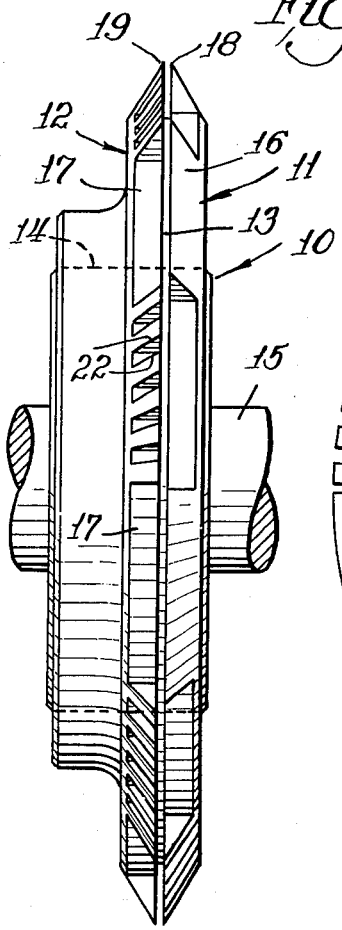
FIG. 3 is a side elevation of an intermittent perforator wheel structure embodying the invention for providing the tearing edge of FIG. 1.

Cutter wheels 11 and 12 define beveled peripheral portions 16 and 17, respectively, defining outer cutting tips 18 and 19, respectively. As shown in FIG. 3, when installed on the mounting member, or bearing, 14, the cutter wheels have the tips 18 and 19 spaced apart the thickness of spacer 13.

Cutter wheel 11 is provided with a plurality of angularly spaced elongated slots 20. Cutter wheel 12 is provided with a plurality of angularly spaced groups 21 of short slots 22. In the illustrated embodiment, each of the plurality of short slots 22 in the groups 21 may have a similar length and the circumferential lengths of the groups 21 may be substantially equal to the circumferential length of the elongated slots 20 of the first cutter wheel.

Figure 2:
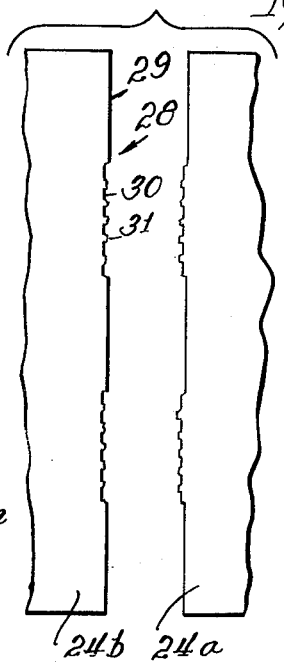
FIG. 2 is a fragmentary plan view thereof as upon separation of the sheet portions along the tearing edge.

The thickness of spacer element 13 may be greater than the length of the slots 22, and in the illustrated embodiment, is greater than the length of the tip edge between the slots 22. Resultingly, in the workpiece, a tearing edge generally designated 23 may be provided in the workpiece 24 by a slitting operation effected by urging the cutter wheel 10 thereagainst with the tearing edge portion being defined by a first line of elongated slits 25 effected by the cutting edge 18 between elongated slots 20 and a group 26 of short slits 27 effected by the cutting edge 19 between slots 22. Slits 27 define a line of slits offset from the line of elongated slits 25 by the thickness of spacer 13. Thus, as seen in FIG. 2, the result of tearing sheet portion 24a from sheet poriton 24b along the tear line 23 is a torn edge 28 having smooth portions 29 defined by slits 25 and tufted portions 30 defined by slits 27 with the individual tufts 31 produced by the tearing operation having a length normally less than the offset of the line of slits 27 from the line of slits 25 so as to define an effectively recessed tufted portion 30. Thus, the torn edge 28 seen by a handling mechanism, such as a data processing machine, is a series of smooth edge portions 29 thereby permitting a smooth flow of sheet 24 through the processing machine without interference by the rough or tufted portions 30 which, as discussed above, are effectively recessed within the line of smooth portions 29.

Thus, as best seen in FIG. 1, the tear edge 23 effectively defines a substantially straight edge while yet providing the improved recessing of the tear tufts with the improved arrangement of the tear line being effected by the novel spaced arrangement of the two cutter wheels 11 and 12.

Figure 4:
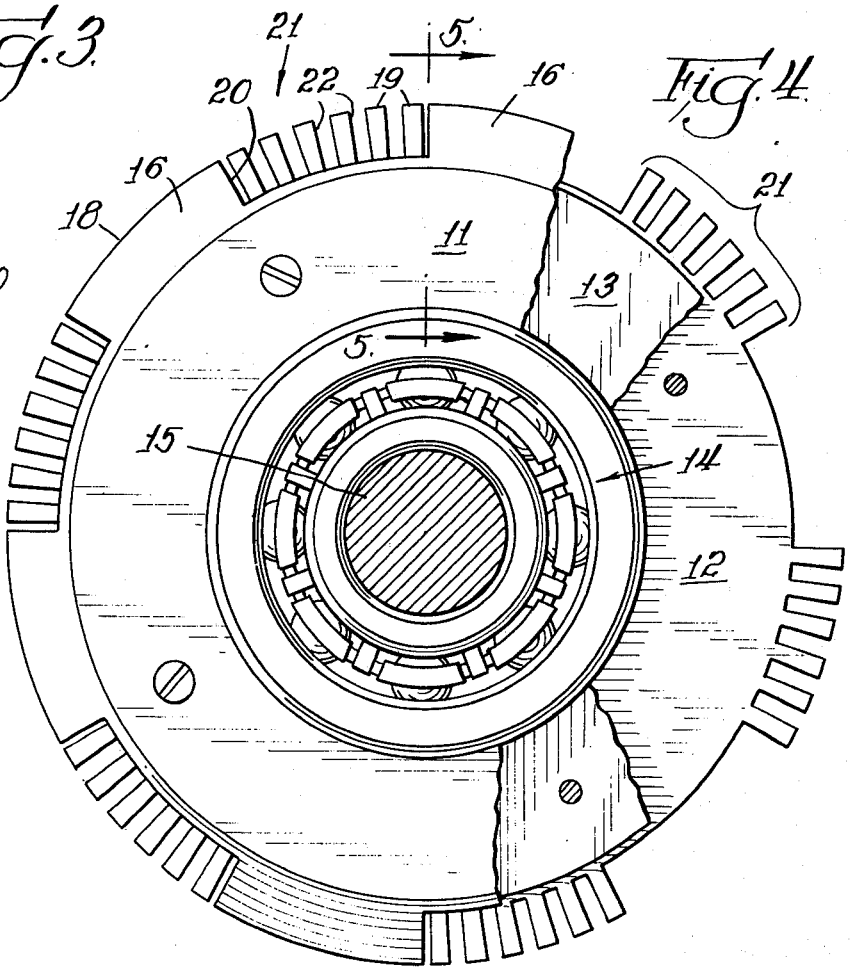
FIG. 4 is an end elevation thereof with portions broken away to facilitate illustration of the wheel structure construction.

As further seen in FIG. 4, the slots 22 are effectively spaced apart a distance substantially equal to the width of the slots. As will be obvious to those skilled in the art, any width slots may be utilized to provide desired edge holding portions in the slit edge means. The circumferential extent of the cutting edge 18 between slots 20 is substantially equal to the circumferential extent of the slot groups 21 in the cutting edge 19 in the illustrated embodiment, it being understood that other suitable desired relationships between these lengths may be utilized within the scope of the invention.

Figure 5:
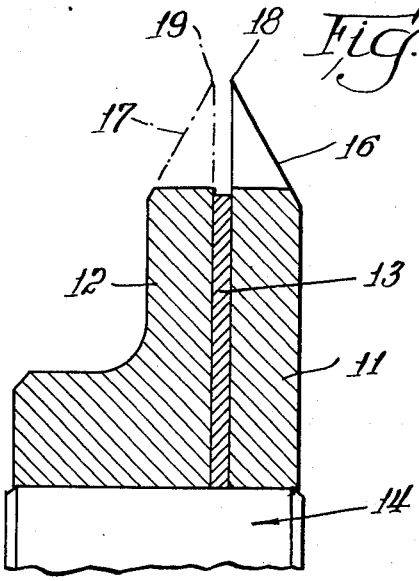
FIG. 5 is a fragmentary enlarged vertical section taken substantially along the line 5—5 of FIG. 4.

The wheels 11 and 12 and spacer 13 may be secured in coaxialy facial engagement, as seen in FIG. 5, by suitable press-fitting of the wheels 11 and 12 to the bearing 14 with the slotted portions of the wheels in aligned relationship, as seen in FIG. 4.

The cutting edges 16 and 17 may be suitably hardened as by heat treating to provide a low maintenance, improved perforator wheel structure as discussed above.

The foregoing disclosure of specific embodiments is illustrative of the broad inventive concepts comprehended by the invention.

I claim:

1. An intermittent perforator wheel structure for providing a tearing edge in a workpiece sheet, comprising:

a first wheel having a peripheral cutting edge provided with a plurality of elongated recesses spaced apart by elongated cutting edge portions;

a second wheel having a peripheral cutting edge provided with a plurality of spaced groups of short recesses spaced apart by short cutting edge portions, and a plurality of elongated recesses intermediate said groups; and means for coaxially securing said wheels with said peripheral edges juxtaposed and with said groups of short recesses of said second wheel aligned one each with said elongated recesses of said first wheel whereby said elongated cutting edge portions of said first wheel comprise means for providing a plurality of spaced elongated slits in a workpiece sheet and said short cutting edge portions of said second wheel comprise means for providing a plurality of spaced short perforation slits in the workpice sheet intermediate the elongated slits cooperatively defining a tearing edge having alternating spaced long slits and groups of short perforation slits.

2. The intermittent perforator wheel structure of claim 1 wherein said elongated recesses of said second wheel have a length substantially equal to the length of said elongated cutting edge portions of said first wheel.

3. The intermittent perforator wheel structure of claim 1 wherein said peripheral cutting edge of the first wheel defines a cutting plane, and the peripheral cutting edge of said second wheel is spaced from said cutting plane.

4. The intermittent perforator wheel structure of claim 1 wherein the length of said elongated cutting edge portions of said first wheel is substantially equal to the length of said groups of short recesses of said second wheel.

5. An intermittent perforator wheel structure for providing a tearing edge in a workpiece sheet, comprising:

a first wheel having a peripheral cutting edge provided with a plurality of elongated recesses spaced apart by elongated cutting edge portions:

a second wheel having a peripheral cutting edge provided with a plurality of spaced groups of short recesses spaced apart by short cutting edge portions, and a plurality of elongated recesses intermediate said groups;

a spacer element; and means for coaxially securing said wheels at opposite sides of said spacer element with said peripheral edges of the wheels in spaced juxtaposed relationship and with said groups of short recesses of said second wheel aligned one each with said elongated recesses of said first wheel whereby said elongated cutting edge portions of said first wheel comprise means for providing a line of spaced elongated slits in a workpiece sheet and said short cutting edge portions of said second wheel comprise means for providing a line of spaced short perforation slits in the workpiece sheet intermediate the elongated slits and offset from the line of said elongated slits by the width of said spacer element, said elongated and short slits cooperatively defining a tearing edge having alternating spaced long slits and groups of short perforation slits.

6. The intermittent perforator wheel structure of claim 5 wherein said spacer element comprises an annular element coaxially secured to between said wheels.

7. The intermittent perforator wheel structure of claim 5 wherein said securing means comprises an axial bearing means.

8. The intermittent perforator wheel structure of claim 5 wherein said securing means comprises an axial bearing means, said wheels and said spacer element being press-fitted thereto.

9. The intermittent perforator wheel structure of claim 5 wherein the width of said spacer element is preselected to offset said line of short slits from the line of said elongated slits a distance greater than the normal projecting portion of the workpiece sheet resulting from the tearing of said workpiece sheet apart along said tearing edge whereby said tearing edge is defined by a series of recesses containing said projecting portions within said line of elongated slits.

10. The intermittent perforator wheel structure of claim 5 wherein the width of said spacer element is greater than the length of said short recesses of said second wheel.

11. The intermittent perforator wheel structure of claim 5 wherein the width of said spacer element is greater than the length of said short cutting edge portions of said second wheel.

* * * * *